US006784846B2

(12) United States Patent
Schnürer

(10) Patent No.: US 6,784,846 B2
(45) Date of Patent: Aug. 31, 2004

(54) ANTENNA FOR AUTOMOBILES AND SET OF COMPONENTS FOR THE SAME

(76) Inventor: Marco Schnürer, Henri-Arnaud-Weg 13, Pforsheim (DE)

( * ) Notice: Subject to any disclaimer, the term of this patent is extended or adjusted under 35 U.S.C. 154(b) by 0 days.

(21) Appl. No.: 10/297,097

(22) PCT Filed: Apr. 19, 2001

(86) PCT No.: PCT/EP01/04421

§ 371 (c)(1),
(2), (4) Date: Nov. 29, 2002

(87) PCT Pub. No.: WO01/95428

PCT Pub. Date: Dec. 13, 2001

(65) Prior Publication Data

US 2003/0179153 A1 Sep. 25, 2003

(30) Foreign Application Priority Data

May 28, 2000 (DE) ..... 100 27 687

(51) Int. Cl.[7] ..... H01Q 1/32
(52) U.S. Cl. ..... 343/711; 343/718
(58) Field of Search ..... 343/711, 712, 343/713, 718, 790, 791, 906, 908

(56) References Cited

U.S. PATENT DOCUMENTS 4,857,014 A * 8/1989 Alf et al. ..... 439/578
4,882,592 A 11/1989 Studer, Jr. et al.
5,926,149 A 7/1999 Rummeli et al.
6,069,588 A * 5/2000 O'Neill, Jr. ..... 343/713

FOREIGN PATENT DOCUMENTS

DE 04440293 * 4/1996 ..... H01Q/1/32
EP 0 389 705 A 10/1999

* cited by examiner

*Primary Examiner*—Shih-Chao Chen

(57) ABSTRACT

An antenna for automobiles including a coaxial coupler, which has an outer conductor, an inner conductor and a plastic supporting body that fixes the inner conductor inside the outer conductor. The antenna also includes a radiating element, which is connected to the inner conductor of the coupler in an electrically conductive manner. A circuit provided for antenna-matching is located on a circuit supporting plate, which is arranged between the radiating element and the inner conductor of the coupler and which extends toward the radiating element. The circuit is also connected to the inner conductor of the coupler as well as to the radiating element in an electrically conductive manner. A plastic sleeve which encapsulates the radiating element in which the outer conductor of the coupler is anchored.

12 Claims, 6 Drawing Sheets

ANTENNA FOR AUTOMOBILES AND SET OF COMPONENTS FOR THE SAME

BACKGROUND OF THE INVENTION

Figure 1:
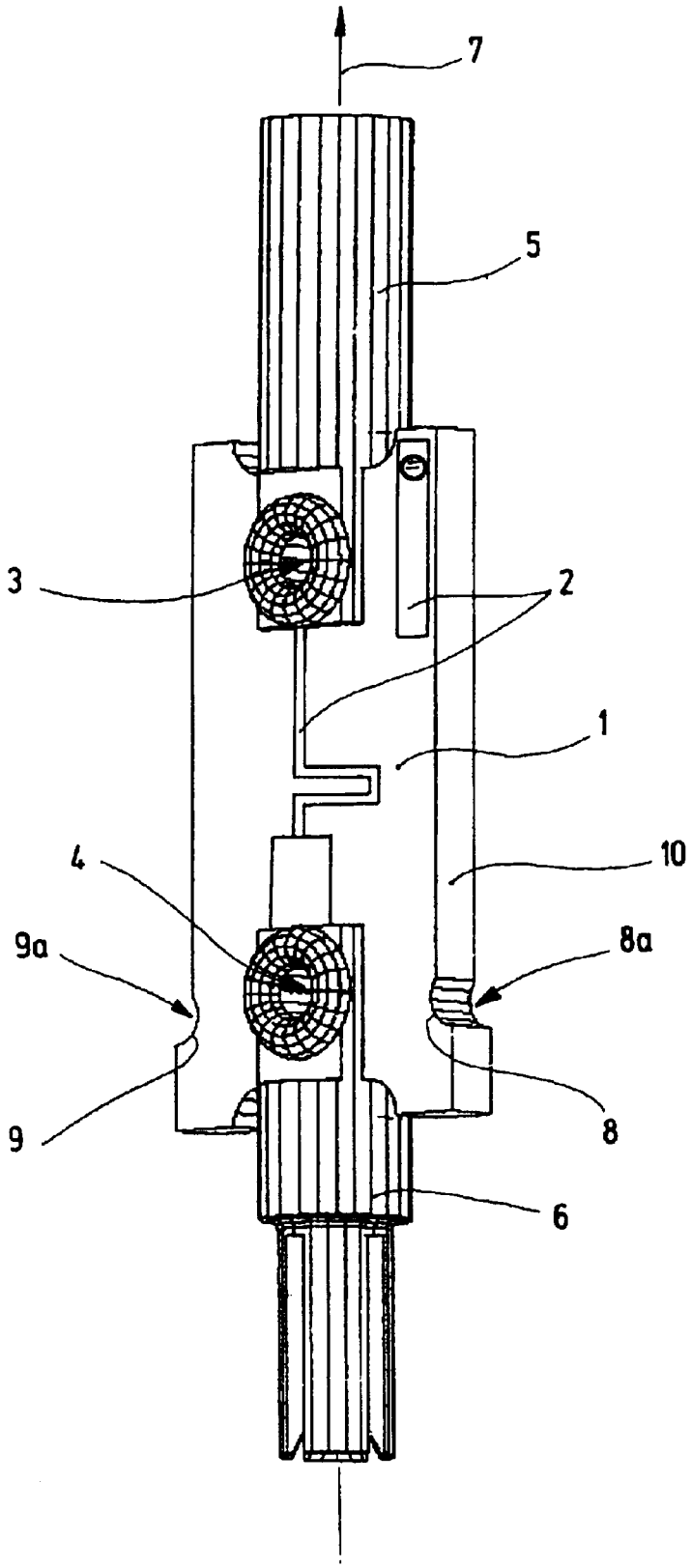

The invention herein starts from on an antenna exhibiting the features disclosed in the preamble of claim 1. An antenna of this type has been known from EP 0 389 705 A2 and features a coaxial coupler comprising an outer conductor, an inner conductor and a plastic supporting body fixing the inner conductor in the outer conductor. Furthermore, such an antenna comprises a radiating element which is connected to the inside of the coupler in an electrically conductive manner. Such an antenna is mounted, for example, with the aid of a base part, to the automobile body panel. A plug fitting said coupler and an antenna cable can be used to connect the receiving device provided in the automobile. For this purpose the automobile's body panel is provided with a bore, which comes into abutment with the edge of the antenna base, thereby creating a connection to ground with the body panel.

Antennas of the above-described type are adjusted to the frequency range in which they are to be used. Different frequency ranges, for example, mobile telephones using the "C" net (450 to 465 MHz), "D" net (890 to 960 MHz), "E" net (1780 to 1920 MHz) or frequencies for navigation systems (Global Positioning System—GPS; 1570 to 1580 MHz) use different antenna configurations. This requires that different components be manufactured and kept in stock.

Furthermore, document DE 44 40 293 C1 discloses an antenna which comprises a sleeve encapsulating a radiating element, whereby an arrangement of a coaxial outer conductor, inner conductor and coupler is anchored to the radiating element.

BRIEF SUMMARY OF THE INVENTION

The invention herein is to solve the problem of finding a method of standardizing the design of antennas of the above-described type and mounting them in a simple manner, despit individual adaptations required by different frequency ranges. The solution of this problem is particularly important considering the cost of antennas, which we supplied to the automobile industry.

In accordance with the invention herein this problem has been solved by the features disclosed in claim 1. Advantageous developments of the invention herein are disclosed in the subclaims.

The antennas of the invention herein are designed, in particular, for high frequencies, specifically for the "C", "D" and "E" nets and for the GPS, as well as for future UMTS applications (Universal Mobile Telecommunications Service), which will be using the frequency range of from 1990 to 2200 MHz.

The invention offers the following substantial advantages:

As a result of the fact that the adaptation of the antenna occurs by means of a circuit, which is located on a circuit supporting plate between the radiating element and the inner conductor of the coupler and is connected to the inner conductor of the coupler as well as the radiating element in an electrically conductive manner, the radiating element for the different possible frequency ranges can be configured in a matching manner. Adaptation, in this case, occurs by means of the circuit on the circuit supporting plate, which features external dimensions that can be selected in a manner matching these different frequency ranges. Therefore, the mechanical design of the antenna may remain the same for these different frequency ranges.

As a result of the fact that the circuit supporting plate extends in longitudinal direction of the radiating element, the circuit may form—with a conductor path oriented in longitudinal direction of the radiating element—a component of said radiating element, so that the active length of the latter extends from the inner conductor of the coupler across the circuit supporting plate to the radiating element and, preferably, beyond the latter, into a terminal radiating element part. For safety reasons, this latter radiating element part is preferably flexible. In order to be able to connect the flexible radiating element part with the radiating element, it is practical to configure the radiating element as a socket, into which the flexible radiating element part can be plugged.

Due to the arrangement of the circuit supporting plate in longitudinal direction of the radiating element, it is possible to accommodate the conductor plate, together with the radiating element and the flexible radiating element part in a slender protective sleeve. As a result a particularly appealing appearance of the antenna can be achieved, this being important for its use on automobiles.

As a result of the fact that Me circuit supporting plate is embedded in the supporting element, a particularly compact design is achieved, separate mounting means for the circuit supporting plate are not necessary, and the circuit supporting plate is protected optimally.

By embedding the circuit supporting plate in the supporting element, the connections of the circuit are fixed and durably protected on one side toward the inner conductor of the coupler and on the other side toward the radiating element.

By embedding the circuit supporting plate in the supporting element, the antenna's design is compact and mechanically highly stable.

The circuit supporting plate can be embedded in the plastic part of the supporting element in such a manner that one or two contact surfaces used for making contact with the outer conductor of the coupler are not embedded but exposed. Contact is made with the outer conductor of the coupler in a particularly simple manner because said coupler is configured accordingly and designed to firmly enclose the supporting element of the coupler. In doing so, contact is automatically made—without additional expense—between the contact surface(s) that are not embedded in the plastic material of the supporting element.

The steps required for antenna installation are the same as for antennas that are adapted to different frequency ranges.

The circuit supporting plate can be embedded in the supporting element in a cost-effective manner in that the circuit supporting plate is with the plastic material of the supporting element by injection molding. To achieve this, an injection mold is used, which, for example, is configured in such a manner that the circuit supporting plate with the already affixed inner conductor of the coupler and with the already affixed radiating element is placed in an injection mold or in a composite injection mold.

The radiating element is encapsulated in a sleeve of plastic material and protected against exposure. This sleeve also extends over the coupler and is anchored to the outside of the coupler.

The inner conductor of the coupler and the radiating element may be connected to the circuit on the circuit supporting plate in a conventional manner. In view of the fact that the circuit supporting plate is embedded in the plastic material of the supporting element, it is particularly favorable to rivet or to hammer-tighten the inside conductor of the coupler and the radiating element in a bore of the circuit supporting plate. Respectively, one conductor path leads to said bores; preferably, these bores feature through connections (in particular, copper-coated by electrolytic metal deposition technique), whereby the metal layer provided in the bore is connected to the conductor path, which leads to the bore on the one side or on the other side of the circuit board.

Contact is made between the outside conductor of the coupler and the respective associate contact surface(s) on the circuit supporting plate or board in a particularly simple and reliable manner if the contact surface is located on the edge surface of the circuit supporting plate. The edge surface is understood to be the narrow surface defined by the thickness of the circuit supporting plate extending in a direction transverse to the two main surfaces, whereby said surface encloses the circuit supporting plate on its edge. Said surface directly faces the inner surface of the outer conductor and can therefore be contacted particularly easily. In conjunction with this, it is particularly advantageous if, as preferably intended, the supporting body comprises an external threaded portion and if the outer conductor of the coupler comprises an internal threaded portion, which allows the coupler to be screwed to the external threaded portion of the supporting body. Consequently, it is possible to achieve a durable and safe as well as water-tight connection between the supporting body and the outer conductor. In conjunction with the fact that the plastic sleeve is anchored to the outer conductor, the antenna is reliably protected against the effects of weather.

Contact is made between the outer conductor and the coupler and the associate contact surface(s) of the circuit supporting plate in a particularly good and safe manner if the contact surface(s), as is preferred, is (are) located on one or two shoulders configured on the edge of the circuit supporting plate, which said shoulder(s) comes (come) into abutment with a projection provided on the inside of the outer conductor, whereby said projection is best ring-shaped, so that it can make contact—in any angular position of the outer conductor on the supporting body—with the contact surface(s) formed on the edge of the circuit supporting plate.

Such a shoulder can be produced in a particularly favorable manner in that, initially, a slightly wider circuit supporting plate is used, that a bore is provided in it to create the shoulders at the intended locations, and that these are plated throughout by means of electrolytic metal deposition in the course of producing the conductor structures on the circuit supporting plate. Thereafter, the edge of the circuit supporting plate is trimmed in such a manner that the separating cut goes through the bore(s) used for contact with the outer conductor of the coupler.

For reasons of symmetry and in order to apply a balanced load to the circuit supporting plate due to the contact with the outer conductor of the coupler, each of the two edges of the circuit supporting plate that extend in longitudinal direction of the radiating element should have such a shoulder. In doing so, it is not necessary, however preferred, that electrical contact occurs on both shoulders.

Preferably, the supporting body projects beyond the outer conductor in the direction toward the radiating element and, conversely, the outer conductor preferably projects in opposite direction beyond the supporting body. This accomplishes that the outer conductor does not shield the circuit supporting plate and, in part, does not even shield the inner conductor. The antenna tapers from its connection end to its tip of the radiating element in steps and, in this manner, can be encapsulated in an external, preferably conically tapering plastic sleeve, thereby providing the antenna with a compact and beautiful design. A coaxial plug can be inserted in the outer conductor, which extends in downward direction over the supporting body.

Inasmuch as the supporting body of this development of the invention herein does not project beyond the outer conductor in downward direction, the supporting body has on its underside—that is, the side facing away from the radiating element—preferably cutouts for the engagement of a turnkey, which is used to drive the supporting body from the underside into the outer conductor and generate the required pressure for abutment of the contact surfaces of the circuit supporting plate against the associate abutment of the outer conductor.

The dimensions of circuit supporting plates, which are kept in stock and comprise different circuits for adapting antennas to different frequency ranges, must match in order to maintain the same mechanical conditions when antennas for different frequency ranges are installed.

BRIEF DESCRIPTION OF THE DRAWING FIGURES

Figure 2:
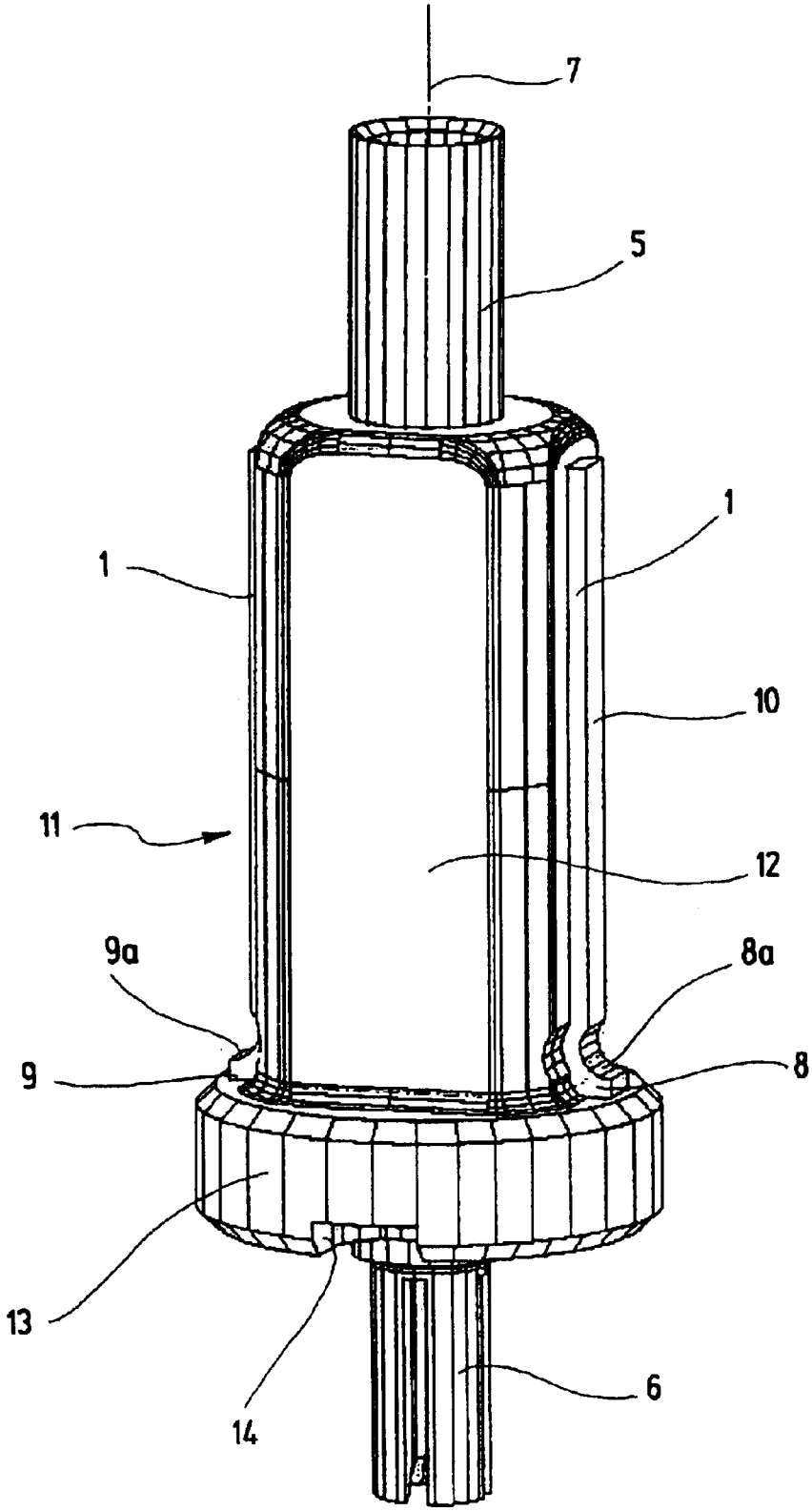
Figure 3:
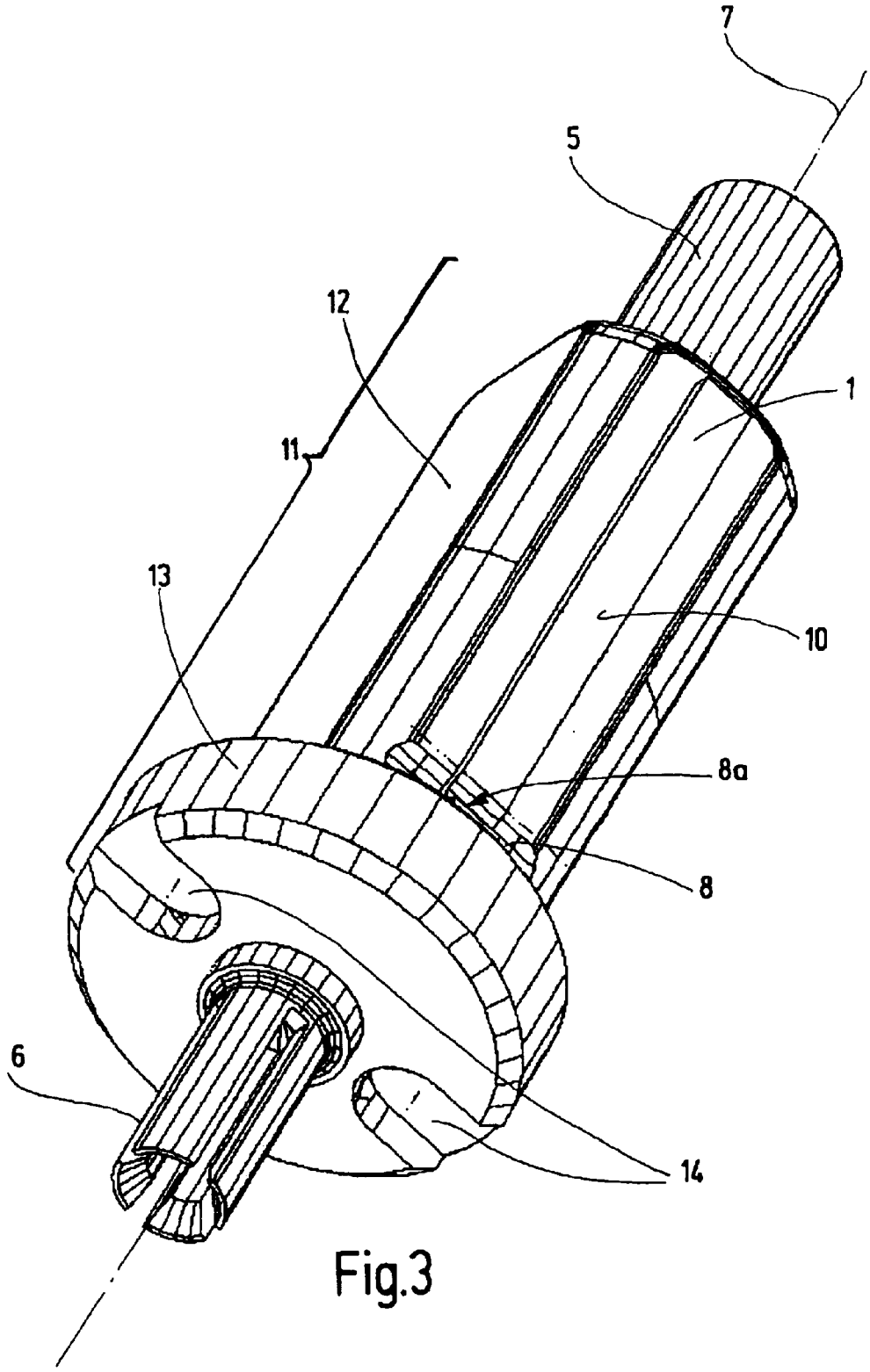
Figure 4:
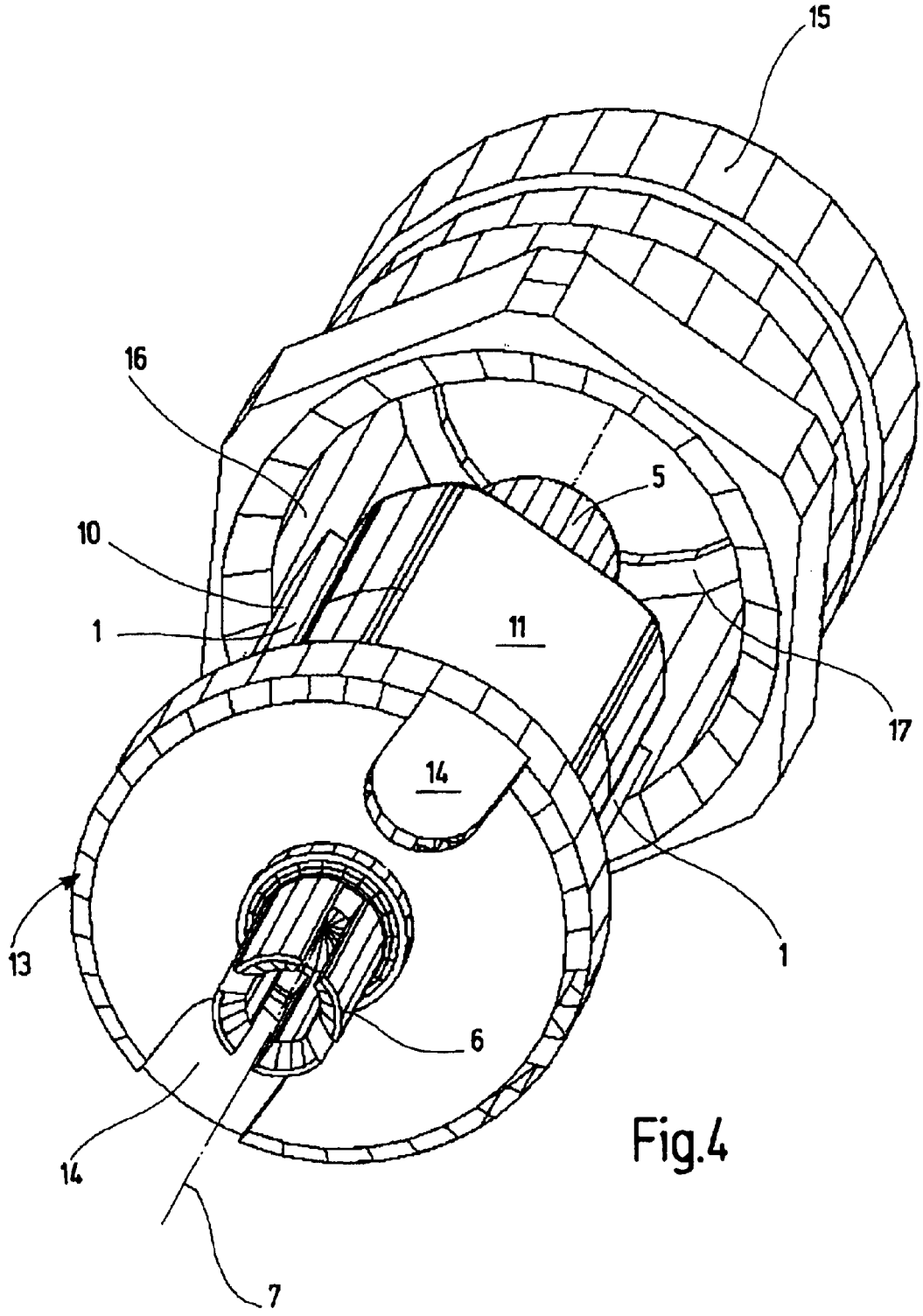
Figure 5:
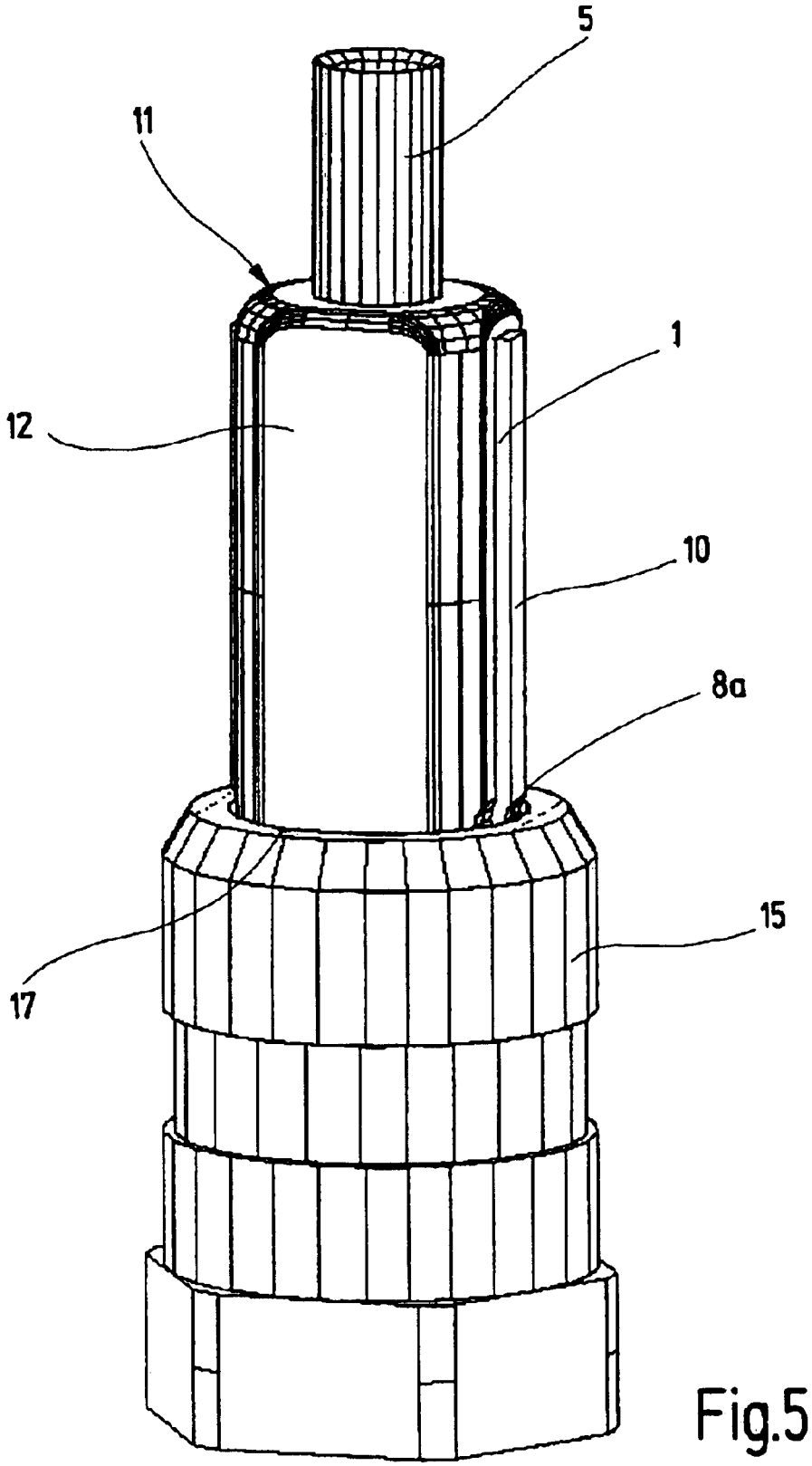
Figure 6:
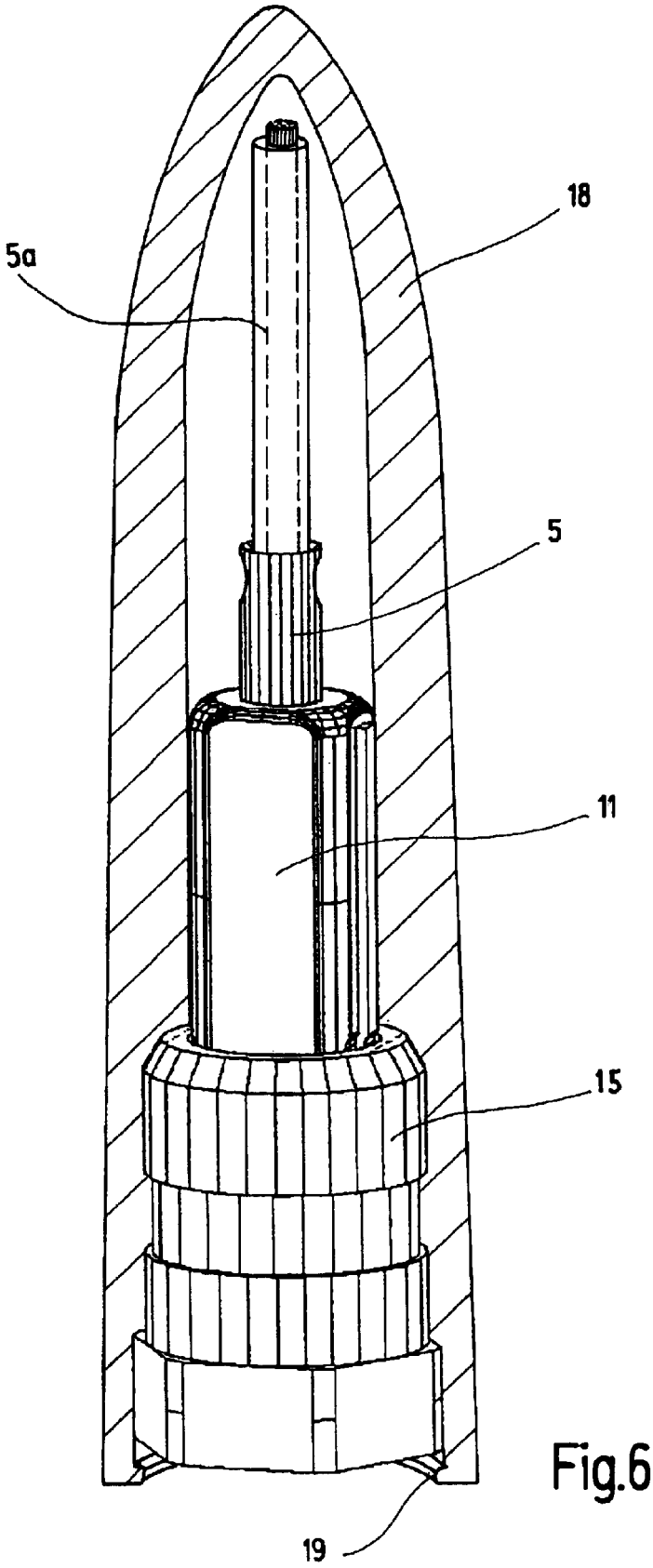

A preferred example of an embodiment of the invention herein is explained with reference to drawings. They show:

FIG. 1 a diagonal view of a greatly enlarged circuit supporting plate, to which a radiating element and an inner conductor of a coupler are mounted;

FIG. 2 a side view of the arrangement of FIG. 1, comprising a plastic-coated supporting body;

FIG. 3 a diagonal view of the component shown in FIG. 2, seen diagonally from the bottom;

FIG. 4 a diagonal view of the component shown in FIG. 2 and 3 as it is being inserted in an outer conductor that is configured as a screw sleeve;

FIG. 5 the component shown in FIGS. 2 and 3, inserted in the outer conductor in accordance with FIG. 4; and FIG. 6 the arrangement of FIG. 5, inserted in a sleeve consisting of plastic material.

DETAILED DESCRIPTION OF THE PREFERRED EMBODIMENT

FIG. 1 shows an elongated, almost rectangular, circuit supporting plate 1, which supports a symbolically illustrated circuit 2 of conductor paths and circuit elements produced by SMD technique. A conductor path extending largely in longitudinal direction of the circuit supporting plate 1 connects a bore 3 in the vicinity of the upper end of circuit supporting plate 1 to a bore 4 in the vicinity of the lower end of circuit supporting plate 1. On the upper bore 3, a radiating element 5 extending in longitudinal direction of circuit supporting plate 1 is riveted to the circuit supporting plate 1. On the lower bore 4, inner conductor 6 of a coaxial coupler is riveted to circuit supporting plate 1. Radiating element 5 and inner conductor 6 are aligned coaxially. Radiating element 5 is configured as a socket, inner conductor 6 as a slotted socket. Both longitudinal edges of the circuit supporting plate 1, which extend parallel to the longitudinal axis 7 of the radiating element 5 and the inner conductor 6, are provided with shoulders 8 and 9; these are arranged dissymmetrically with respect to longitudinal axis 7. Both shoulders 8 and 9 are provided on edge surface 10 of the circuit supporting plate 1; these shoulders 8 and 9 are remainders of two originally present metal-plated bores, from which, subsequently, more than half of their periphery was removed by trimming the edge of the circuit supporting plate 1.

The assembly shown in FIG. 4 is coated with plastic in an injection mold in order to produce a supporting body 11 shown in FIGS. 2 and 3. In doing so, circuit supporting plate 1 is embedded almost completely in plastic material: exceptions are the two longitudinal edges, which have shoulders 8 and 9 with associate contact surfaces 8*a* and 9*a*. At the same time circuit supporting plate 1 is coated by injection molding, whereby inner conductor 6 and radiating element 5 are partially embedded in the plastic material.

On the whole, supporting body 11 is an elongated, essentially prism-shaped body 12 with an adjoining circular screw flange 13, on the shell surface of which a screw thread was formed by injection molding. On the underside of screw flange 13, in diagonal arrangement, are two cutouts 14, which can come into engagement with a turnkey at the time of assembly.

Screw flange 13 of the component shown in FIGS. 2 and 3 is screwed into an outer conductor 15 that is configured as a metal screw sleeve with an internal thread 16. A circular abutment 17 projecting toward the inside is provided on the upper end of outer conductor 15. The component shown in FIGS. 2 and 3 is screwed from the underside into outer conductor 15 until its shoulders 8 and 9 abut against abutment 17. With respect to the longitudinal axis 7, the abutment surface of abutment 17 is contoured conically and designed in such a manner that abutment 17 not only creates a firm contact with contact surfaces 8*a* and 9*a* but, in addition, creates a firm contact at a point of the screw flange—which is at somewhat greater radial distance—with said flange; this offers the advantage that moisture cannot enter from the underside between supporting body 11 and the sleeve of the outer conductor 15 and move upward into the region of the radiating element.

FIG. 5 shows the component shown in FIGS. 2 and 3, after it has been firmly screwed into the sleeve of outer conductor 15.

FIG. 6 shows the arrangement shown in FIG. 5, enclosed by a sleeve 18 of plastic material, the outside of said sleeve 18 having the form of a slender cone. Said sleeve 18 consists of plastic material and has preferably been injection molded around outer conductor 15 before the assembly step shown in FIG. 4, so that said conductor 15 is anchored in a fixed and water-tight manner in sleeve 18. The profile of the inside of sleeve 18 is selected such that it encloses the portion of supporting body 11 projecting from outer conductor 16 in a relatively tight manner and encloses radiating element 5 with greater clearance. Furthermore, FIG. 6 shows that in the case of this embodiment, another radiating element part 5*a* adjoins radiating element 5 in order to achieve the radiating element length appropriate for the intended purpose of use of the antenna. To achieve this, radiating element part 5*a* is inserted in radiating element 5 that is configured as a socket and secured therein by crimping, for example. The additional radiating element part 5*a* preferably is a flexible metal cord in a plastic sheath.

Sleeve 18 projects beyond the lower edge of outer conductor 15 and has on its lower edge an inwardly projecting bead 19 that is used to engage said sleeve with a not illustrated base part of the antenna. Said base part, in turn, can be used to mount the antenna to the body panel of an automobile and to pass the inner conductor through a hole in said body panel.

What is claimed is:

1. An antenna for automobiles comprising:

a coaxial coupler, which has an outer conductor, an inner conductor and a plastic supporting body, which fixes the inner conductor inside the outer conductor, a radiating element, which is connected to the inner conductor of the coupler in an electrically conductive manner, whereby a circuit provided for matching the antenna is located on a circuit supporting plate, which is arranged between the radiating element and the inner conductor of the coupler and which extends in the direction of the radiating element, said circuit being also connected to the inner conductor of the coupler as well as to the radiating element in an electrically conductive manner, and a plastic sleeve, which encapsulates the radiating element and in which the outer conductor of the coupler is anchored, and wherein the circuit supporting plate is embedded in the supporting body and, on the edge thereof, has a contact surface, which is not covered by the plastic of the supporting body, and which is configured for contact with the outer conductor of the coupler.

2. The antenna in accordance with claim 1, wherein the circuit supporting plate is embedded in the plastic material of the supporting body by injection molding.

3. The antenna in accordance with claim 1 or 2, wherein the inner conductor of the coupler and the radiating element are riveted or hammer-tightened in a bore in the area of a conductor path.

4. The antenna in accordance with claim 1, wherein in order to make contact with the outer conductor of the coupler, a contact surface is located on the edge surface of the circuit supporting plate.

5. The antenna in accordance with claim 1, wherein the supporting body has a portion provided with an external thread and the outer conductor has an internal thread, which is used to screw said outer conductor to the external thread of the supporting body.

6. The antenna in accordance with claim 4, wherein the contact surface is located on a shoulder formed on the edge of the circuit supporting plate, whereby an abutment provided on the inside of the outer conductor abuts against said shoulder.

7. The antenna in accordance with claim 6, wherein the shoulder represents the remainder of a metal-plated bore of the circuit supporting plate, said remainder being created by removing a part of the circuit supporting plate.

8. The antenna in accordance with claim 6 or 7, wherein both of the edges of the circuit supporting plate, which extend in longitudinal direction of the radiating element, are provided with one such shoulder.

9. The antenna in accordance with claim 1, wherein the supporting body projects beyond the outer conductor in the direction toward the radiating element and the outer conductor projects beyond the supporting body in opposite direction.

10. The antenna in accordance with claim 5, wherein the supporting body has, on its side facing away from the radiating element, cutouts used for engagement of a turnkey.

11. A component set for an antenna in accordance claim 1, said component set comprising several circuit supporting plates that have the same dimensions but support different circuits.

12. The antenna in accordance with claim 4, wherein the supporting body has a portion provided with an external thread, and the outer conductor has an internal thread which is used to screw said outer conductor to the external thread of the supporting body, and wherein the contact surface is located on a shoulder formed on the edge of the circuit supporting plate, whereby an abutment provided on the inside of the outer conductor abuts against said shoulder.

* * * * *